US007525262B2

(12) United States Patent
Carow

(10) Patent No.: US 7,525,262 B2
(45) Date of Patent: Apr. 28, 2009

(54) AUTOMATIC CLOTHES DRYER

(75) Inventor: James P. Carow, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 14 days.

(21) Appl. No.: 11/033,658

(22) Filed: Jan. 12, 2005

(65) Prior Publication Data

US 2006/0152178 A1 Jul. 13, 2006

(51) Int. Cl.
*H02P 5/00* (2006.01)

(52) U.S. Cl. ..... 318/59; 318/66; 318/254

(58) Field of Classification Search ..... 318/59, 318/66, 138, 254, 700–800; 34/260, 524, 34/570

See application file for complete search history.

(56) References Cited

U.S. PATENT DOCUMENTS 3,152,462 A * 10/1964 Elliott et al. ..... 68/12.02
3,203,679 A 8/1965 Williams et al.
3,265,948 A * 8/1966 Sones et al. ..... 318/799
3,266,168 A 8/1966 Sones et al.
3,286,361 A 11/1966 Cobb et al.
3,612,500 A 10/1971 Cramer ..... 263/33
3,942,265 A 3/1976 Sisler et al. ..... 34/45
4,086,707 A * 5/1978 Bochan ..... 34/554
4,158,527 A * 6/1979 Burkett ..... 417/18
4,231,166 A * 11/1980 McMillan ..... 34/553
4,286,391 A 9/1981 Gerry ..... 34/44
4,733,479 A * 3/1988 Kaji et al. ..... 34/446
4,860,231 A * 8/1989 Ballard et al. ..... 702/47
5,050,313 A * 9/1991 Wakaeya et al. ..... 34/454
5,062,219 A * 11/1991 Harris et al. ..... 34/606
5,174,859 A * 12/1992 Rittof et al. ..... 162/29
5,291,667 A 3/1994 Joslin et al. ..... 34/44
5,443,541 A 8/1995 St. Louis ..... 34/486
5,505,313 A 4/1996 Smith et al. ..... 209/579
5,555,645 A * 9/1996 Joslin ..... 34/499
5,680,021 A * 10/1997 Hollenbeck ..... 318/432
5,714,859 A * 2/1998 Irie ..... 318/561
5,862,826 A * 1/1999 Gremont ..... 135/124
5,905,648 A * 5/1999 Badami ..... 700/55
6,098,310 A * 8/2000 Chen et al. ..... 34/475
6,141,887 A * 11/2000 Chen et al. ..... 34/475
6,154,978 A 12/2000 Slutsky
6,353,303 B1 * 3/2002 Ramachandran et al. .... 318/727
6,637,127 B2 10/2003 Reeds ..... 34/527
6,643,953 B2 11/2003 Song et al. ..... 34/604
6,647,643 B2 11/2003 Song et al. ..... 34/595

(Continued)

FOREIGN PATENT DOCUMENTS

DE 196 13 310 A1 10/1996

(Continued)

*Primary Examiner*—Bentsu Ro
*Assistant Examiner*—Thai Dinh
(74) *Attorney, Agent, or Firm*—Clifton Green; Michael D. Lafrenz

(57) ABSTRACT

An automatic clothes dryer comprises a cabinet in which is rotatably mounted a drum that defines a drying chamber and a motor for rotating the drum. A variable speed blower is mounted within the interior space and is fluidly coupled to the drying chamber for moving air through the drying chamber at varying flow rates to improve the drying of the clothes.

25 Claims, 5 Drawing Sheets

U.S. PATENT DOCUMENTS

| | | | | |
|---|---|---|---|---|
| 6,691,536 | B2 | 2/2004 | Severns | 68/21.27 |
| 6,708,134 | B2 * | 3/2004 | McGaughey et al. | 702/145 |
| 6,745,495 | B1 * | 6/2004 | Riddle et al. | 34/497 |
| 6,751,888 | B2 | 6/2004 | Lueckenbach | 34/595 |
| 6,757,988 | B2 | 7/2004 | Bruntz et al. | 34/543 |
| 6,785,981 | B1 | 9/2004 | Harpenau | 34/140 |
| 6,792,694 | B2 | 9/2004 | Lapierre | 34/446 |
| 6,874,250 | B2 * | 4/2005 | Prajescu et al. | 34/606 |
| 6,984,948 | B2 * | 1/2006 | Nakata et al. | 318/254 |
| 7,017,280 | B2 * | 3/2006 | Green et al. | 34/486 |
| 2004/0055176 | A1 | 3/2004 | Yang et al. | |
| 2004/0060197 | A1 | 4/2004 | Jeong et al. | 34/595 |

FOREIGN PATENT DOCUMENTS

| | | | |
|---|---|---|---|
| JP | 3-178699 | | 8/1991 |
| JP | 4-193298 | | 7/1992 |
| JP | 06-031098 | * | 2/1994 |
| JP | 11-047498 | * | 2/1994 |
| JP | 10-43496 | * | 2/1998 |

* cited by examiner

AUTOMATIC CLOTHES DRYER

BACKGROUND OF THE INVENTION

1. Field of the Invention

The invention relates generally to automatic clothes dryers. In one aspect, the invention relates to a blower assembly for an automatic clothes dryer utilizing a variable-speed blower motor. In another aspect, the invention relates to a method for adjusting the air flow rate through an automatic clothes dryer drum.

2. Description of the Related Art

Automatic clothes dryers are well known, and typically comprise a cabinet enclosing a horizontally rotating drum for holding items to be dried and accessible through an access door at the front of the cabinet. The drum is rotated by a first belt which is driven by a motor. The motor also drives a blower or fan directly by a shaft connection or by a second belt; the blower delivers dry, heated or unheated air to the drum for drying the items, and exhausts humid air from the drum to a discharge location exterior of the cabinet. The motor and blower assembly are typically mounted in a lower portion of the cabinet beneath or to the side of the drum. The belts are driven by pulleys attached to a rotating shaft of the motor, generally at opposite ends of the motor.

The motor typically rotates at a preselected angular velocity based to achieve a prescribed operational angular velocity for the dryer drum. The angular velocity of the blower is thus linked to the angular velocity of the dryer drum. The angular velocity of the drum is generally maintained constant in order to impart a desired tumbling action to the dryer load, so that the angular velocity of the blower cannot be adjusted during the drying cycle. In other words, the speed of the motor is fixed, which means the blower speed is also fixed. As such, the air flow rate through the drum cannot be varied in response to changes in conditions within the drum such as: load size, type of garment being dried, and initial moisture content of the load; or to user imposed conditions such as pre-selected dryer cycle settings or differences in consumer exhaust vent conditions. Currently, only the heat and cycle time can be varied in response to a change in the conditions. The ability to alter the air flow rate independently of the angular velocity of the drum would provide for additional control over the drying cycle, without negatively impacting clothes load tumbling, which is highly desirable.

SUMMARY OF THE INVENTION

A method for controlling the operation of an automatic clothes dryer according to a drying cycle comprising a drying chamber for receiving articles of clothing, and an air flow system comprising a motor and a blower driven by the motor for forcing air through the drying chamber. The method comprises determining the air flow through the air flow system, comparing the determined air flow to a desired air flow, and adjusting the motor speed such that the air flow through the air flow system approaches the desired air flow.

Adjusting of the motor speed comprises setting a controlled motor speed for the motor speed and operating the motor at the controlled motor speed. The adjusting of the motor speed further comprises determining a current motor speed and comparing the controlled motor speed to the current motor speed. The current motor speed is estimated based on an operating parameter of the motor.

The comparing of the determined air flow to the desired air flow comprises determining an error value based on the difference between the determined air flow and the desired air flow. The method further comprises comparing the error value to a predetermined deviation value, and adjusting the motor speed if the error value is greater than the deviation value. The method further comprises limiting the adjustment of the motor speed within a predetermined range.

The determining of the determined air flow comprises estimating the air flow based on at least one of the motor speed, air temperature, and motor torque. The determining of the air flow comprises sensing an operational characteristic of a blower motor in the air flow system. The sensed operational characteristic comprises at least one of motor speed, air temperature, and motor torque. The adjusting of the motor speed comprises adjusting the motor speed to maintain the air flow at a constant desired air flow.

The adjusting of the motor speed comprises at least one of increasing and decreasing the motor speed, and altering the desired air flow during the drying cycle and adjusting the motor speed to obtain the altered desired air flow. The altering of the desired air flow during the drying cycle comprises setting a desired air flow for at least one of the following steps of the drying cycle: warm-up, constant-rate drying, falling-rate drying, and cool down. The adjusting of the desired air flow is done in response to the temperature of the air in the air flow system, the dryness of a clothes load in the dryer, the mass of the clothes, and the volume of the clothes load in the dryer.

In another embodiment, an automatic clothes dryer comprises a cabinet defining an interior space, a drum rotatably mounted within the interior space and defining a drying chamber, a blower fluidly coupled to the drying chamber for moving ambient air into and exhausting air from the drying chamber, a variable speed motor operably coupled to the blower for adjusting air flow from the blower, a motor speed determiner that outputs a signal representative of the motor speed, and a controller operably coupled to the variable speed motor and the motor speed determiner to adjust the speed of the variable speed motor in response to a signal from the motor speed determiner to adjust the speed of the motor to maintain the air flow at a predetermined set point.

The motor speed determiner can comprise a sensor coupled to the motor to sense a characteristic of the motor that is representative of the motor speed. The sensors can comprise at least one of a current sensor, or torque sensor, or equivalent sensorless processing means. The automatic clothes dryer can further comprise an exhaust temperature sensor coupled to the controller. The variable speed motor can comprise one of a continuously variable motor and a discretely variable motor. The variable speed motor can be directly coupled to the blower. The variable speed motor can have a rotating shaft and the blower impeller can be coaxially coupled. The blower can be a centrifugal blower.

DESCRIPTION OF AN EMBODIMENT OF THE INVENTION

Figure 1:
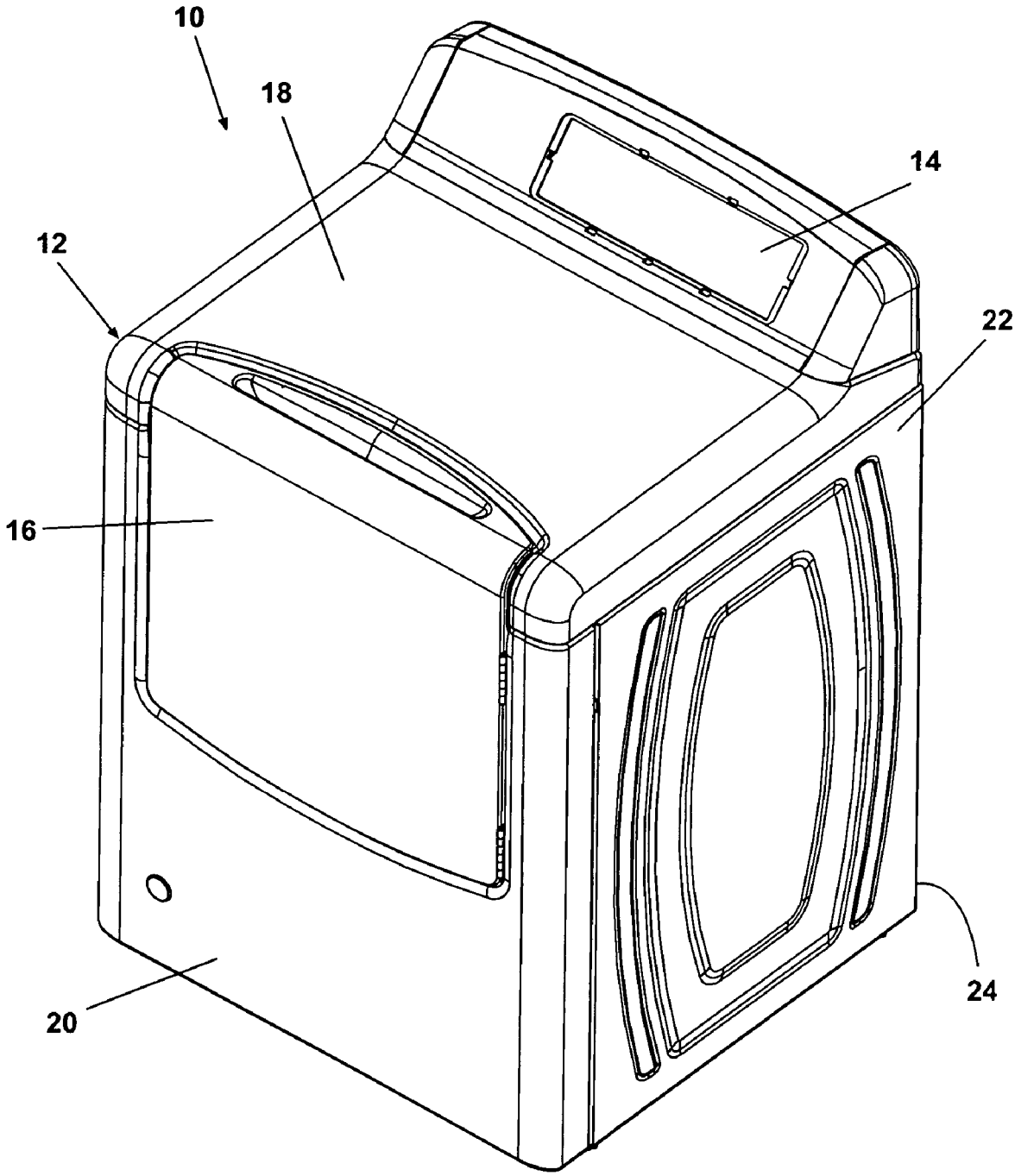
FIG. 1 is a perspective view of an automatic clothes dryer comprising a cabinet enclosing a rotating drum and a blower assembly utilizing a variable-speed blower motor according to the invention.

Referring to the Figures, and in particular to FIG. 1, an embodiment of an automatic clothes dryer 10 according to the invention is illustrated comprising a cabinet 12 enclosing a control panel 14 for controlling the operation of the dryer 10, a door 16 hingedly attached to a front wall 20, a rear wall 24, and a pair of side walls 22 supporting a top wall 18. The clothes dryer 10 described herein shares many features of a well-known automatic clothes dryer, and will not be described in detail except as necessary for a complete understanding of the invention.

Figure 2:
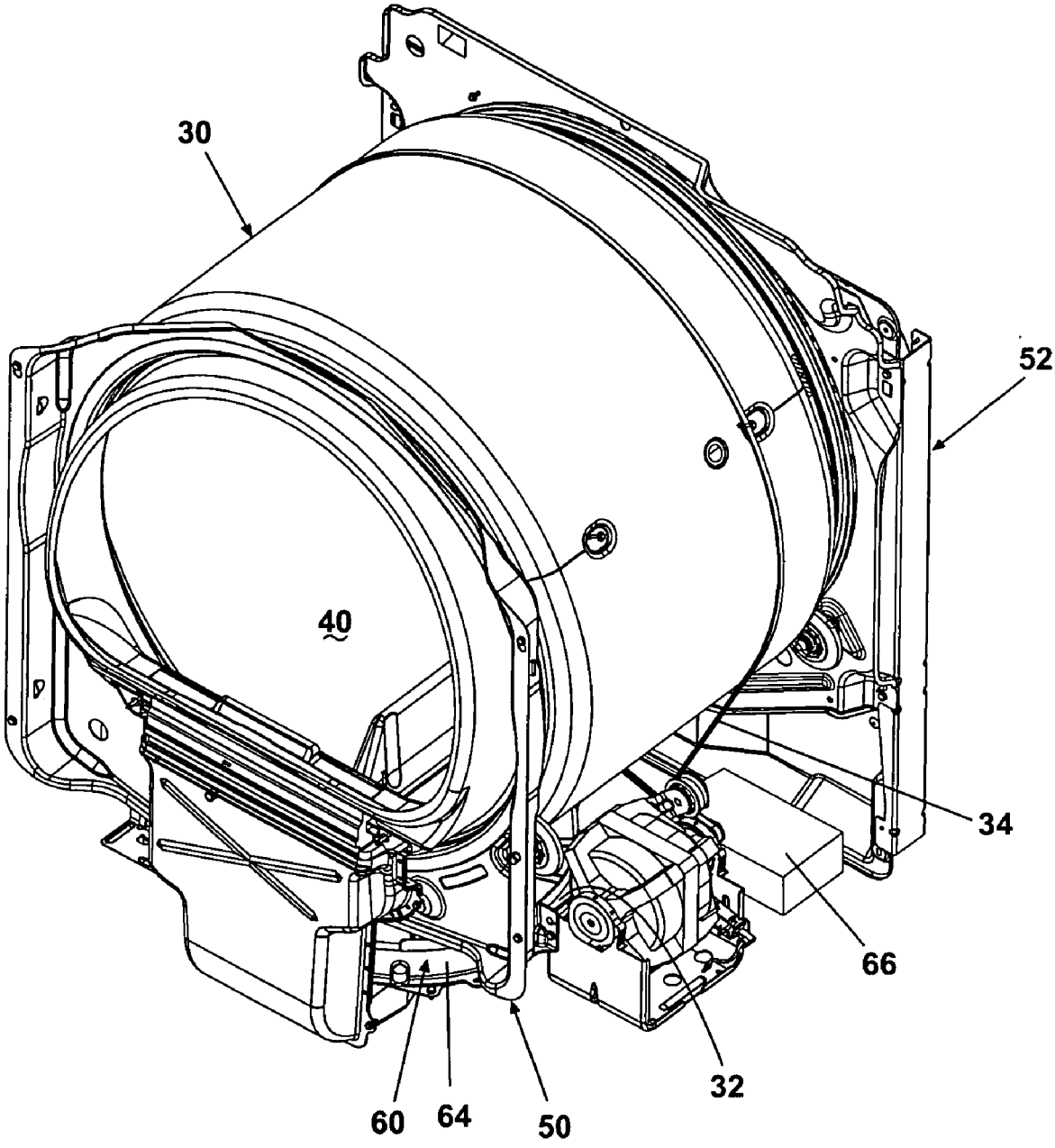
FIG. 2 is a perspective view of the automatic clothes dryer illustrated in FIG. 1 with portions removed for clarity, illustrating the blower assembly.

FIG. 2 illustrates the dryer 10 with the cabinet 12 removed to disclose the interior of the dryer 10, which comprises a rotating drum 30 rotatably suspended in a well-known manner between a front drum panel 50 and a rear drum panel 52. The front drum panel 50 is provided with an opening for access to the interior of the drum 30 which defines a drying chamber 40. The cabinet 12 also encloses a drum motor assembly 32 adapted in a well-known manner for rotating the drum 30 via a drum belt 34, and a blower assembly 60, which is partially visible beneath the drum 30.

Figure 3:
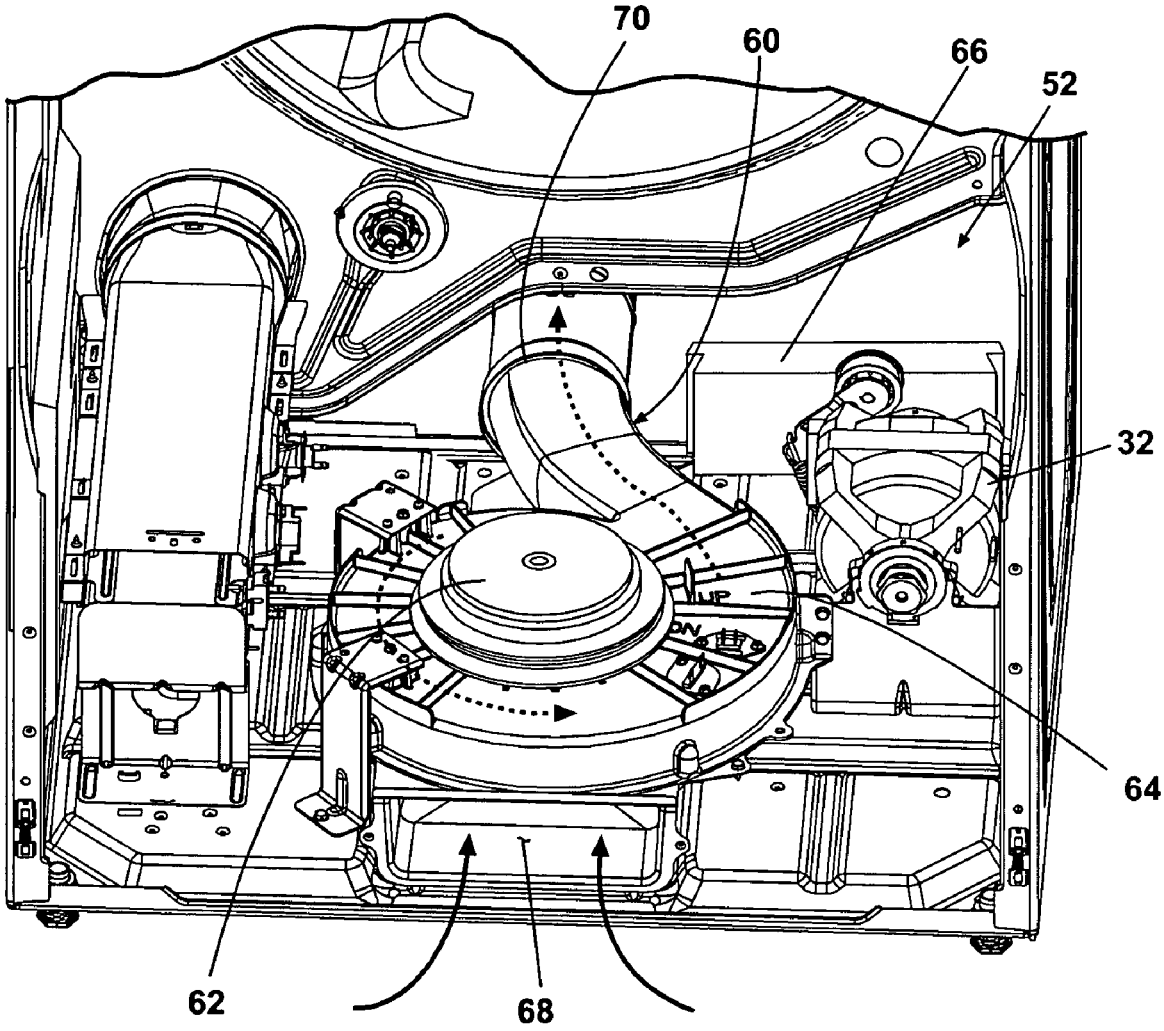
FIG. 3 is a perspective view of the blower assembly illustrated in FIG. 2.

The blower assembly 60 is more clearly illustrated in FIG. 3, when the drum is removed. The blower assembly 60 comprises a blower motor 62, a blower 64, and a blower motor controller 66. The blower 64 comprises a centrifugal blower comprising a rotating impeller (not shown) enclosed in a housing which is configured to draw in air coaxially and exhaust the air tangentially in a direction orthogonal to the direction of air flow through the impeller. Thus, air is drawn into the blower 64 through a blower inlet 68, as illustrated by the solid line flow vectors, and passes tangentially through the blower housing under the influence of the impeller, as illustrated by the dotted line flow vectors, to exit a blower outlet 70. The impeller is driven by the blower motor 62, which is illustrated in FIG. 3 as coaxial with the impeller. Preferably, the rotating shaft of the blower motor 62 also comprises the rotating shaft of the impeller so that the blower motor 62 and the impeller constitute a direct-drive unit.

The blower motor 62 is a variable speed motor capable of rotation within a preselected range of angular velocities, based for example on controlled variations in voltage or current. The motor 62 can be continuously variable or discretely variable, i.e. operable at one of a preselected number of differing speeds. Preferably, the blower motor 62 is a well-known brushless permanent magnet (BPM) motor, and is provided with one of the many well known methods for evaluating the angular velocity of the motor and the torque developed by the motor. Such methods include monitoring the motor voltage, motor current, variations in motor voltage or current, or other operational characteristics. These methods are well known to one of ordinary skill in the art and are not germane to the invention. The blower motor 62 is operably interconnected, such as through well-known electrical connections, with the blower motor controller 66, including a power supply connection.

Figure 4:
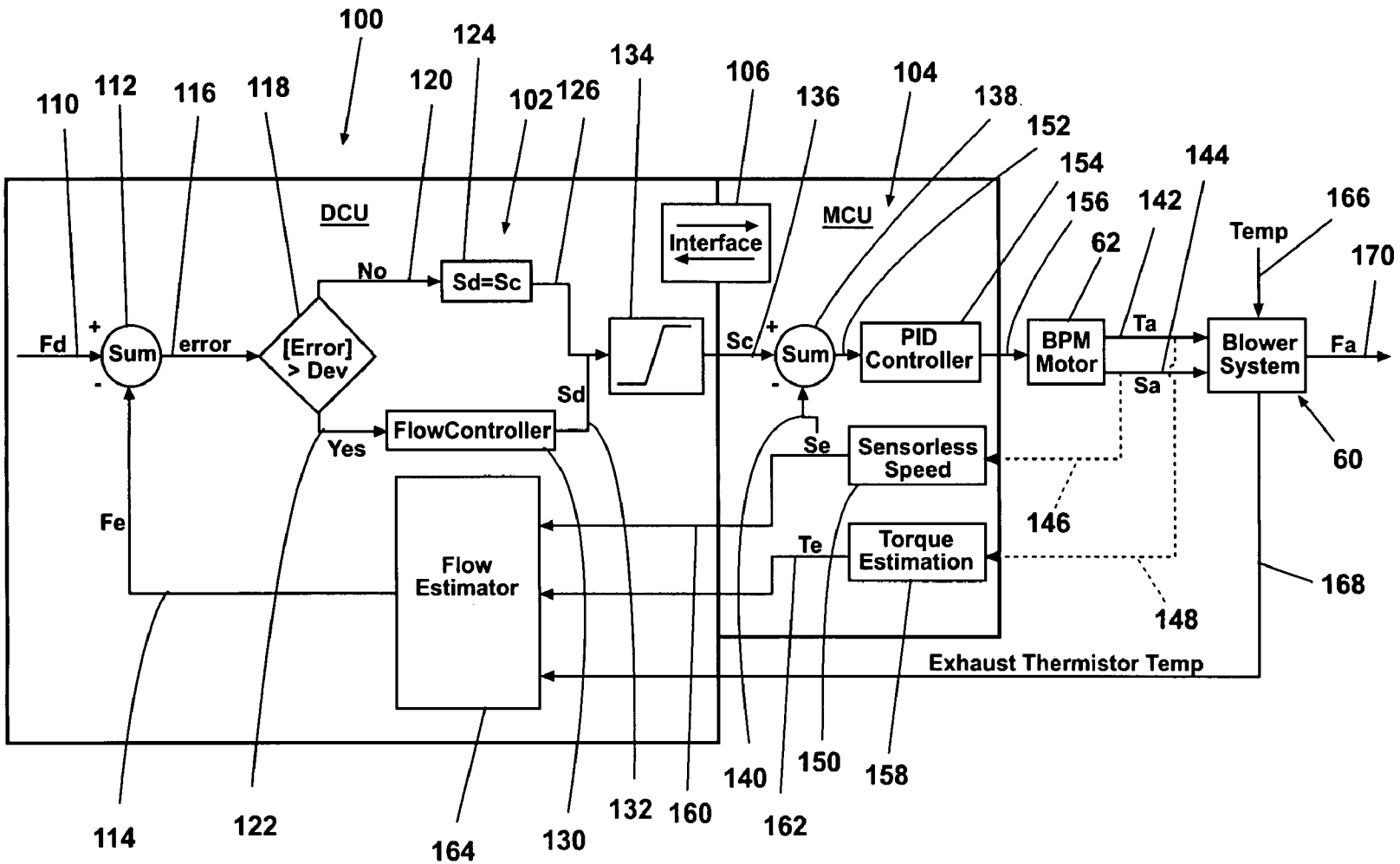
FIG. 4 is a flow diagram illustrating a process steps for controlling the operation of the variable-speed blower motor.

FIG. 4 is a schematic illustrating a controller 100 located in the blower motor controller 66 to control air flow delivered by the blower assembly 60. In effect, the controller 100 performs a logic routine which controls the blower motor 62 to produce a desired air flow based upon motor speed, motor torque, and blower exhaust temperature. Control of the blower motor 62 involves processing in both a dryer control unit (DCU) 102 and a motor control unit (MCU) 104. Both units 102, 104 can be physically located together at any suitable location in the dryer, such as in the blower motor controller 66 as illustrated. Alternatively, the dryer control unit 102 can be located remotely from the blower motor controller 66, which would contain only the motor control unit 104. The location of the units is not germane to the invention. In either configuration, the dryer control unit 102 and the motor control unit 104 bi-directionally communicate through a communication interface 106 in a well-known master-slave configuration. The dryer control unit 102 comprises the master unit, and the motor control unit 104 comprises the slave unit. The units 102 and 104 can be either hardware, software or a combination of both.

The controller 100 establishes an actual air flow delivered by the blower assembly 60 to the drying chamber 40 by adjusting the speed of the blower motor 62, which is accomplished by evaluating torque and speed information for the blower motor 62, and air temperature information from the blower outlet 70, and utilizing the information in an algorithm to compare an estimated air flow value with a preselected air flow set-point. If the absolute value of the difference between the estimated air flow value and the preselected set-point is less than or equal to a preselected deviation value, no adjustment to the speed of the blower motor 62 is made. If the estimated air flow value differs from the preselected set-point more than the preselected deviation value, the motor speed is adjusted, and the comparison is repeated. The process is repeated until the difference in estimated and preselected speeds is less than or equal to the deviation value.

The controller 100 evaluates a desired flow input ($F_d$) 110, which is preferably a predetermined value pre-programmed into the dryer control unit 102, and can take different values during a preselected drying cycle. It is anticipated that the desired flow input value will be established for a specific dryer configuration and a preselected drying cycle (e.g., normal cycle, low heat cycle, delicate fabrics cycle, etc.) based upon empirical data developed for each dryer configuration. The desired flow input 110 is compared with an estimated flow input ($F_e$) 114 in a flow comparison step 112. The difference between the desired flow input 110 and the estimated flow input 114 is termed an "error" and comprises an error input 116 for an error magnitude logic step 118.

In the error magnitude logic step 118, the absolute value of the error input 116 is compared with a preselected deviation value. The deviation value reflects an acceptable variation between the desired flow input 110 and the estimated flow input 114 which requires no correction in blower system performance. If the absolute value of the error input 116 is less than the deviation value, a negative input signal 120 is generated and the desired speed ($S_d$) of the blower motor 62 is equated with a controlled speed ($S_c$) value in a speed select step 124. In other words, no change in blower motor speed is effected. If, however, the absolute value of the error input 116 is greater than the deviation value, an affirmative input signal 122 is generated and the desired speed ($S_d$) of the blower motor 62 is modified in a flow adjustment step 130. Depending upon the results from the error magnitude logic step 118, the desired speed ($S_d$) value from the speed select step 124 comprises a speed limit input 126 to a speed limit logic step 134. Alternatively, the desired speed ($S_d$) value from the flow adjustment step 130 comprises a speed limit input 132 to the speed limit logic step 134.

In the speed limit logic step 134, the desired speed ($S_d$) value is compared with preselected maximum and minimum speed limits for the blower motor 62. As a practical matter, the variable speed motor 62 may be limited to operation between an upper speed limit and a lower speed limit. Thus, the controller 100 must be configured so that speeds outside this range are not called for. As an example, the speed limit logic step 134 may be configured with a minimum motor speed of, say for illustrative purposes, 1000 rpm and a maximum motor speed of 2600 rpm. If the desired speed ($S_d$) value is less than 1000 rpm, the controlled speed ($S_c$) is set at 1000 rpm. If the desired speed ($S_d$) value is greater than 2600 rpm, the controlled speed ($S_c$) is set at 2600 rpm. Desired speeds ($S_d$) intermediate these two limits are established as the controlled speed ($S_c$). The controlled speed ($S_c$) becomes a controlled speed input 136 for a speed comparison step 138.

In the speed comparison step 138, the controlled speed ($S_c$) is compared with an estimated blower motor speed input 140. During the logic routine performed by the controller 100, the blower motor 62 is operating at an actual speed ($S_a$) which is an input 144 to the blower assembly 60. However, the actual speed ($S_a$) is not measured. An electrical signal 146 indicative of the actual speed ($S_a$) is input to an algorithm as part of a speed estimation step 150, which establishes an estimated speed ($S_e$). The estimated speed ($S_e$) is used instead of the actual speed ($S_a$). For purposes of the invention, the estimated speed is sufficient and more cost effective than determining the actual speed.

Similarly, an electrical signal 148 indicative of the actual motor torque ($T_a$), which is also not measured, is input to an algorithm as part of a motor torque estimation step 158, which establishes an estimated motor torque ($T_e$). Motor torque is indicative of the dryer load and the flow resistance. The estimated motor torque ($T_e$) is used to establish the estimated flow $F_e$ for the flow comparison step 112, and is used instead of the actual motor torque ($T_a$). For purposes of the invention, the estimated motor torque is sufficient and more cost effective than determining the actual motor torque.

The estimated speed ($S_e$) is input 140 to the speed comparison step 138 for comparison with the controlled speed ($S_c$). The deviation between the estimated speed ($S_e$) and the controlled speed ($S_c$) is a speed deviation input 152 to a Proportional Integral Derivative (PID) controller 154. The PID controller 154 sends an adjustment signal 156 to the blower motor 62 for adjustment of the speed of the motor such that the controlled speed equals the estimated speed. The PID controller 154 maintains the motor 62 at the controlled speed.

The estimated speed ($S_e$) is also used as an estimated motor speed input 160 for a flow estimation step 164. The estimated torque ($T_e$) is also used as an estimated motor torque input 162 for the flow estimation step 164. A temperature input 166 is generated by a sensor, such as a thermistor, in the blower outlet 70, which is used as a temperature input 168 for the flow estimation step 164. An algorithm is utilized in the flow estimation step 164 to establish the estimated flow input ($F_e$) 114 for the air flow comparison step 112.

The disclosed controller 100 provides a continuous feedback loop control of the motor speed based on the actual flow of the air through the dryer. Adjustment of the blower motor speed results in an actual flow ($F_a$) generated by the blower assembly 60.

It should be noted that the estimated speed $S_e$ and estimate torque $T_e$ can be determined by any suitable speed determiner or torque determiner. Traditional sensors can be used that sense the actual speed or torque. Estimators can also be used. For example, the speed and torque signals 146, 148 can be signals representing the current passing through the motor and the motor torque, respectively. These signals can be generated by the onboard control of the motor 62. For purposes of this invention, whether an actual sensor is used or an estimator is used is not material.

Figure 5:
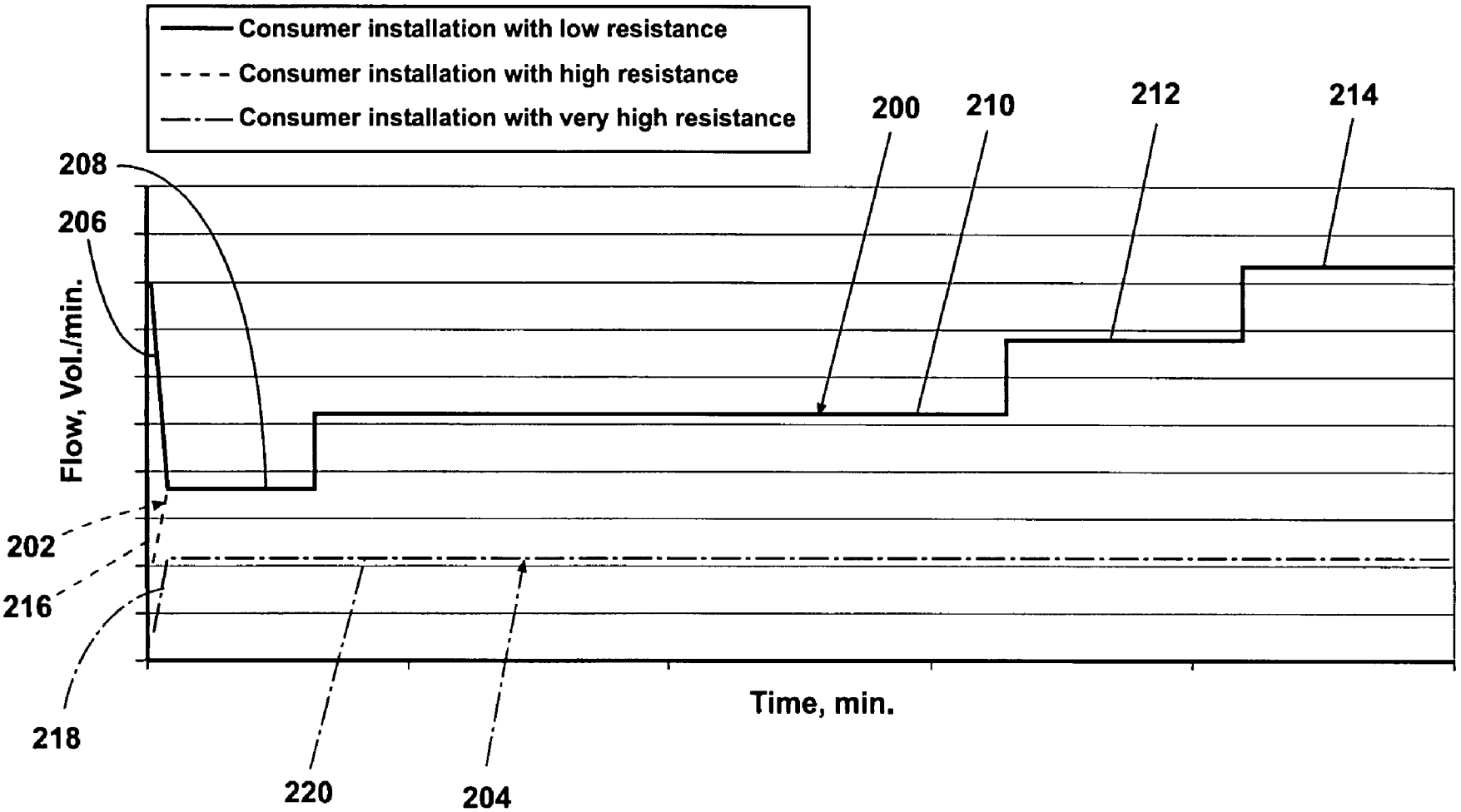
FIG. 5 is a graphical representation of flow characteristics for three different conditions of air flow resistance through an automatic clothes dryer utilizing the variable-speed blower motor according to the invention.

Referring now to FIG. 5, the performance of the blower assembly 60 is illustrated for three conditions. The first condition 200 reflects a low resistance flow condition such as would occur with a small dryer load, a clean lint trap, and an unobstructed dryer vent enabling air to be readily exhausted from the dryer 10. The second condition 202 reflects a high resistance flow condition such as would occur with a large dryer load, a somewhat unobstructed lint trap, and a somewhat unobstructed dryer vent. The third condition 204 reflects a very high resistance flow condition such as would occur with a very large dryer load, a highly obstructed lint trap, and a highly obstructed dryer vent.

In general, the first step in drying comprises quickly heating the drying chamber 40 to a selected initial drying temperature. Heating of the drying chamber is illustrated in FIG. 5 for the low resistance flow condition 200 by the drum heating flow 208. The drum heating flow 208 is preferably low in order to reduce the flow of heated air out of the drying chamber 40, thereby facilitating the heating of the drying chamber 40. The steps 206 and 208 form a warm-up portion of the drying cycle. At a time t=0, which corresponds to the initiation of a selected drying cycle, the controller 100 is provided with a desired flow $F_d$ based upon the selected drying cycle, but has no data, such as dryer load or temperature, upon which to establish an estimated air flow value $F_e$. Thus, the blower motor 62 is initially operated at a pre-selected motor speed which is pre-programmed into the controller, but which may be different than the motor speed required for the desired flow $F_d$. The logic routine is performed to establish an estimated flow $F_e$, and adjust the motor speed to that required for the desired flow. For the low resistance condition 200, the flow at time t=0 is illustrated as high relative to the drum heating flow 208, corresponding to a relatively high motor speed. Thus, the motor speed is progressively reduced in order to adjust the flow to the drum heating flow 208. It is anticipated that this will occur over a relatively short period of time.

After the drying chamber 40 has been warmed-up, flow from the blower assembly 60 is increased to an initial drying flow 210, during which the drying chamber 40 is maintained at a high temperature to quickly remove moisture from the load by operating the blower assembly 60 to deliver a relatively low flow to the drying chamber 40. Step 210 is a constant rate drying portion of the drying cycle as the rate of evaporation is relatively constant for the heat input.

As the load dries, eventually there is less water to absorb the heat from the air and the rate of drying or evaporation falls, resulting in an increase in temperature of the drying chamber for the given heat input. To avoid overheating of the clothes, air flow from the blower assembly 60 is increased at step 212. Step 212 is the falling rate portion of the drying cycle. Ultimately, the clothes will reach the desired degree of drying. It is then beneficial to actively cool the heated clothes. This is accomplished in the cool down portion 214 where the air flow rate is further increased to more rapidly cool the clothes.

In short, the controller 100 continuously controls the speed of the motor and thus the air flow based upon changes in the dryer load and temperature. Flow is also adjusted during the drying cycle in order to accommodate the reduction in flow through the drying chamber 40 that can occur when the drying load "fluffs up" and expands to fill the drying chamber 40, and while lint accumulates on the lint filter.

For the second condition 202, the higher resistance to flow may mean that the initial pre-selected motor speed is too low to provide a desired drum heating flow for satisfactorily heating the drying chamber 40. Thus, at time t=0, the flow is illustrated as low relative to the drum heating flow 208, even though the motor may be operating at a relatively high motor speed. Thus, the air flow must be increased 216 in order to increase the flow to the desired drum heating flow 208. The motor speed is progressively increased by performance of the logic routine in the controller 100 in order to adjust the air flow up to the drum heating flow 208. It is anticipated that this will occur over a relatively short period of time. Assuming that the speed of the blower motor 62 can continue to be increased as called for by the logic routine, the remaining steps 210-214 in the drying cycle after the drum heating flow step 208 would be identical to the first condition 200 for the same selected drying cycle.

However, it is possible that a high resistance flow condition exists which, in effect, will tax the output of the blower motor 62. For this very high resistance flow condition 204, the initial heating of the drying chamber 40 will be effected by an increase in output 218 from the blower assembly 60, similar to the increase in output 216 for the second condition 202. However, the resistance may be sufficiently high that the blower motor 62 is operating at its upper limit (i.e. the controlled speed $S_c$ from the speed limit logic step 134 is limited by the preselected upper limit), so that the blower assembly 60 is operating at a maximum airflow and cannot provide any increased flow to the drying chamber 40. In this condition, a constant flow 220 is maintained.

The flow conditions 200, 202, 204 described herein are illustrated as stepped conditions. Alternatively, the controller 100 can control the blower assembly 60 output to provide a continuous, rather than discrete, flow adjustment. Furthermore, the stepped changes from one flow to another can be ramped, rather than instantaneous, as illustrated in FIG. 5.

The variable speed blower drive described herein provides several advantages over a prior art dryer having a single motor driving both the drum and the blower. Most significantly, the use of a separate variable speed blower drive enables the blower speed, and consequently air flow, to be selectively varied without affecting in an adverse way the tumbling characteristics of the drum. Dryer flow rates can be adjusted to a selected optimum set point based upon air flow factors such as load size, lint accumulation, exhaust vent length and construction, and the like. Noise can be minimized by rotating the blower motor at the minimum speed required for optimum performance in a specific cycle. Dryer cycles can be improved by minimizing cycling of the heating element. Dryer efficiency can be improved by utilizing an optimum flow rate for a selected drying cycle. Drying time can be reduced by reducing air flow to a minimum rate in order to shorten the time taken by the initial heating of the drying chamber and load. Peak clothing temperatures can be reduced by increasing air flow to a higher rate late in the drying cycle when the surface of the clothing is no longer saturated.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method for controlling the operation of an automatic clothes dryer according to a drying cycle comprising a drying chamber for receiving articles of clothing, and an air flow system comprising a motor and a blower driven by the motor for forcing air through the drying chamber, the method comprising:

estimating the air flow through the air flow system;

comparing the estimated air flow to a desired air flow; and adjusting the motor speed in response to the comparison such that the air flow through the air flow system approaches the desired air flow.

2. The method according to claim 1, wherein the adjusting of the motor speed comprises setting a controlled motor speed for the motor speed and operating the motor at the controlled motor speed.

3. The method according to claim 2, wherein the adjusting of the motor speed further comprises determining a current motor speed and comparing the controlled motor speed to the current motor speed.

4. The method according to claim 3, wherein the current motor speed is estimated based on an operating parameter of the motor.

5. The method according to claim 1, wherein the comparing of the estimated air flow to the desired air flow comprises determining an error value based on the difference between the estimated air flow and the desired air flow.

6. The method according to claim 5, and further comprising comparing the error value to a predetermined deviation value.

7. The method according to claim 6, and further comprising adjusting the motor speed if the error value is greater than the deviation value.

8. The method according to claim 7, and further comprising limiting the adjustment of the motor speed within a predetermined range.

9. The method according to claim 1, wherein the estimating of the air flow comprises sensing an operational characteristic of the blower motor in the air flow system.

10. The method according to claim 9, wherein the sensed operational characteristic comprises at least one of motor speed, air temperature, motor current, and motor torque.

11. The method according to claim 1, wherein the adjusting of the motor speed comprises adjusting the motor speed to maintain the air flow at a constant desired air flow.

12. The method according to claim 1, wherein the adjusting of the motor speed comprises at least one of increasing and decreasing the motor speed.

13. The method according to claim 1, wherein the adjusting of the motor speed comprises altering the desired air flow during the drying cycle and adjusting the motor speed to obtain the altered desired air flow.

14. The method according to claim 13, wherein the altering of the desired air flow is done in response to the air temperature in the air flow system.

15. The method according to claim 13, wherein the altering of the desired air flow is done in response to dryness of a clothes load in the dryer.

16. The method according to claim 13, wherein the altering of the desired air flow is done in response to the mass of the clothes load in the dryer.

17. The method according to claim 13, wherein the altering of the desired air flow is done in response to the volume of the clothes load in the dryer.

18. A method for controlling the operation of an automatic clothes dryer according to a drying cycle comprising a drying chamber for receiving articles of clothing, and an air flow system comprising a motor and a blower driven by the motor for forcing air through the drying chamber, the method comprising:

estimating the air flow through the air flow system based on at least one of the motor speed, air temperature, motor current, and motor torque;

comparing the estimated air flow to a desired air flow; and adjusting the motor speed in response to the comparison such that the air flow through the air flow system approaches the desired air flow.

19. An automatic clothes dryer, comprising:

a cabinet defining an interior space;

a drum rotatably mounted within the interior space and defining a drying chamber;

a blower fluidly coupled to the drying chamber for moving ambient air into and exhausting air from the drying chamber;

a variable speed motor operatively coupled to the blower for adjusting air flow from the blower; and a controller operatively coupled to the variable speed motor for adjusting the speed of the variable speed motor in response to estimating the air flow through the drying chamber and comparing the estimated air flow to a desired air flow.

20. The automatic clothes dryer according to claim 19, wherein the variable speed motor is one of a continuously variable motor and a discretely variable motor.

21. The automatic clothes dryer according to claim 20, wherein the variable speed motor is directly coupled to the blower.

22. The automatic clothes dryer according to claim 21, wherein the variable speed motor has a rotating shaft and the blower is coupled to the shaft.

23. The automatic clothes dryer according to claim 22, wherein the blower is a centrifugal blower.

24. The automatic clothes dryer according to claim 19, wherein the controller estimates the air flow based on sensing an operational characteristic of the variable speed motor.

25. The automatic clothes dryer according to claim 24, wherein the sensed operational characteristic comprises at least one of motor speed, air temperature, motor current, and motor torque.

* * * * *